US005759276A

United States Patent [19]

Addison, Jr.

[11] Patent Number: 5,759,276

[45] Date of Patent: Jun. 2, 1998

[54] SHIELD FOR PROTECTING VEHICLE BODY

[76] Inventor: Curtis Addison, Jr., 5956 Richfield Ave., Hope Mills, N.C. 28348

[21] Appl. No.: 901,292

[22] Filed: Jul. 5, 1997

[51] Int. Cl.[6] ..... B05C 21/00

[52] U.S. Cl. ..... 118/504; 118/505; 301/37.1

[58] Field of Search ..... 118/504, 505, 118/213, 301, 406; 301/37.1

[56] References Cited

U.S. PATENT DOCUMENTS

| | | | |
|---|---|---|---|
| D. 371,337 | 7/1996 | Williams | D12/213 |
| 2,081,666 | 5/1937 | Gunn | 118/505 |
| 4,787,331 | 11/1988 | Jarvis | 118/504 |
| 4,811,991 | 3/1989 | Moreno et al. | 301/37.1 |
| 5,070,810 | 12/1991 | Dieter | 118/505 |
| 5,667,590 | 9/1997 | Simon, Sr. | 118/504 |

FOREIGN PATENT DOCUMENTS

| | | | |
|---|---|---|---|
| 2240290 | 7/1991 | United Kingdom | 118/505 |

*Primary Examiner*—Laura Edwards

[57] ABSTRACT

A shield for protecting a vehicle body when adding protectant or dressing to vehicle tires. The shield protects the body panels and fenders from cleaning fluid or protectant spray mist which may damage the finish of a vehicle. The protective device has a flexible collar which conforms to the tread portion of the tire and an overspray cape attached to the flexible collar.

1 Claim, 2 Drawing Sheets

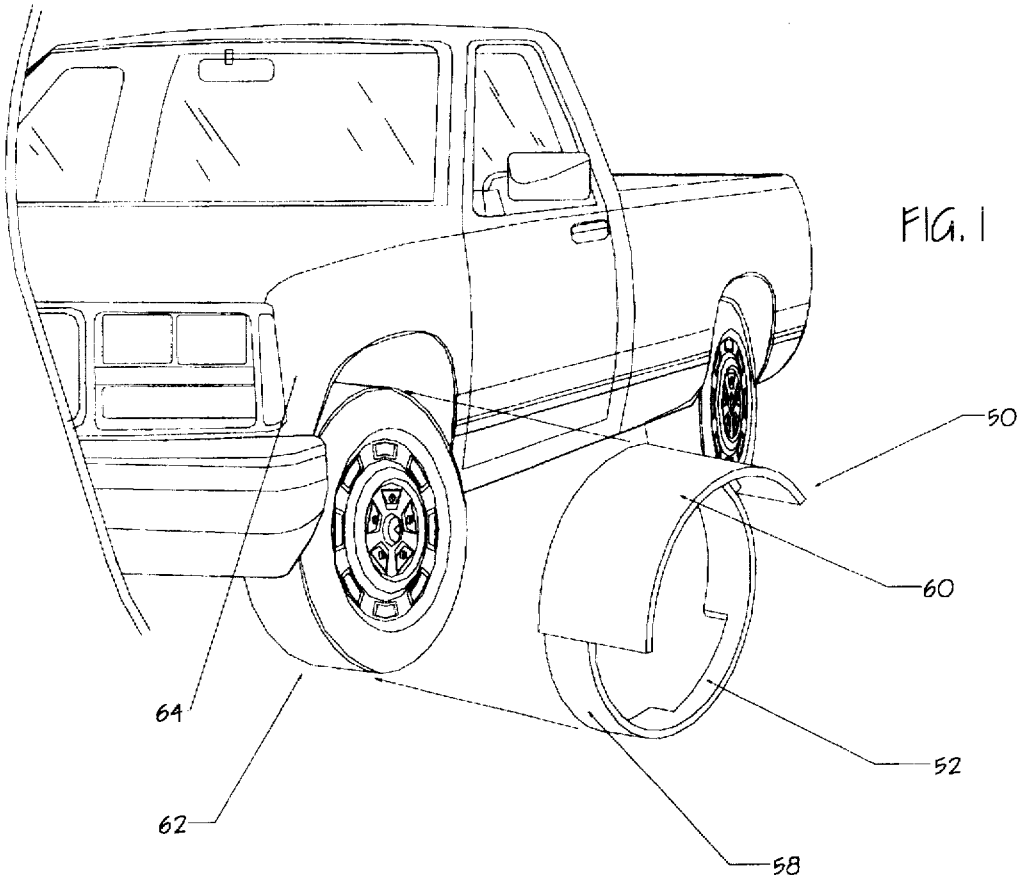
FIG. 1
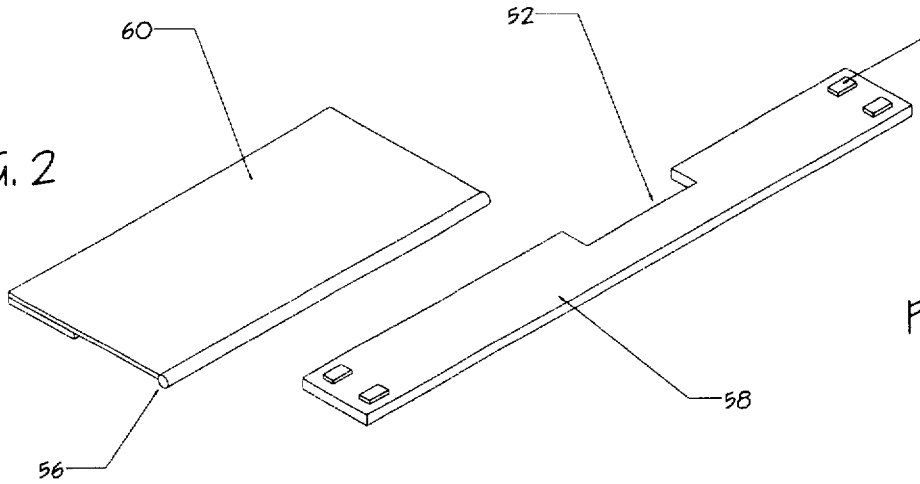
FIG. 2
FIG. 3

SHIELD FOR PROTECTING VEHICLE BODY

FIELD OF INVENTION

This invention relates to shields, specially protective shield for use with vehicles.

BACKGROUND OF THE INVENTION

U.S. Pat. No. D371,337 to Williams, Timothy Jul. 2, 1996 provides an ornamental design for a spray shield. U.S. Pat. No. 4,787,331 to Jarvis, Randall R. Nov. 29, 1988 provides a shield for use when spraying automobile panels to protect the wheels and tires. These devices were intended to protect the tires and wheels when treating the body panels of vehicles.

U.S. Pat. No. 5,070,810 to Dieter, Maron S. Dec. 10, 1991 provides a shield to protect the tires when treating the wheels. This device intends only to protect the tires so that the wheels may be treated. U.S. Pat. No. 4,811,991 to Moreno, Ernie A. and Ray D. Mar. 14, 1989 is a tire rim protector for masking the tire rim while applying protectant. This device only takes into consideration the protection of the tire rim while applying protectant and not the body panels of the vehicle. The present invention intends to provide protection for the body panel surfaces of the vehicle while treating the tires.

BRIEF SUMMARY OF THE INVENTION

Accordingly, several objects and advantages of the invention are as follows: to provide a means for one to protect the body panels of a vehicle from overspray while applying cleaner or protectant to vehicle tires, to provide a protective shield adaptable to various sizes of tires, and to provide a means of securing the protective shield around the tire.

Further objects and advantages will become apparent from a consideration of the following description and the accompanying drawings.

DRAWING FIGURES

FIG. 1 is a partial perspective view of a protective shield in accordance with the invention.

FIG. 2 is an isometric view of the protective shield of FIG. 1.

FIG. 3 is an isometric view of the protective shield of FIG. 1.

REFERENCE NUMERALS IN DRAWINGS

50 protective shield 52 tire cutout

54 connectors 56 tubing

58 collar 60 overspray cape

62 tire 64 body panel

DESCRIPTION OF A PREFERRED EMBODIMENT

Figure 4:
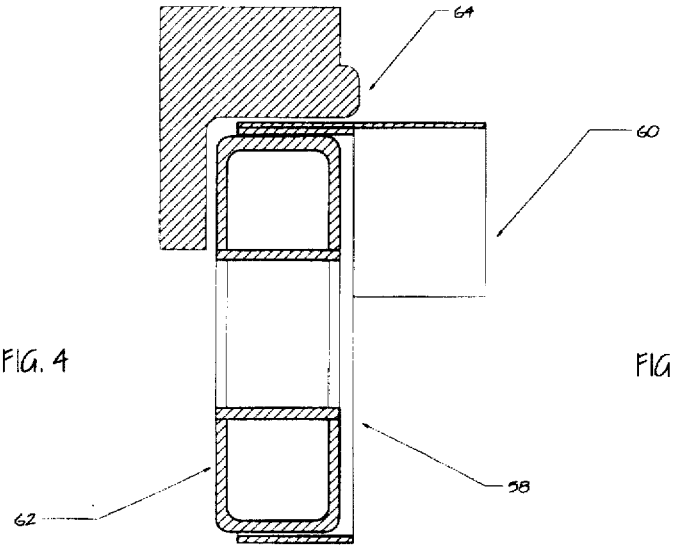
FIG. 4 is a sectional view of a protective shield of FIG. 1.
Figure 5:
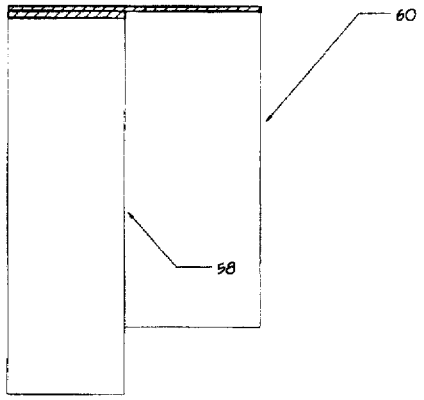
FIG. 5 is a similar view, but where the shield is larger.

The preferred embodiment of the invention is illustrated in FIG. 1. The protective shield is generally, referred to by the numeral 50, consisting of a flexible collar 58 and having a tire cutout 52 on the portion of the flexible collar 58 which touches the ground surface. In FIG. 2, the flexible collar 58 has connector 54 to which the overspray cape 60 (FIG. 3) is attached. The outer edge of overspray cape 60 is bounded with tubing 56 to keep a semi-annular shape when attached to the tire 62. The flexible collar 58 can also be similar in length as the overspray cape 60 (FIG. 5) and lie across the tire 62 not having the tire cutout 52.

The protective shield 50 is attachable to a tire 62 by disconnecting the connectors 54 and fitting the flexible collar 58 around the outside of a tire 62 positioning the tire cutout 52 on the ground surface in front of the tire 62. Placing the tire cutout 52 around the lowest portion of the tire 62 prevents protectant from flowing onto the ground surface. The overspray cape 60 covers the upper portion of the outside of the tire 62. Spray protectant is sprayed protecting the body panels 64 from mist. Several connectors 54 can be disposed at intervals to allow custom fitting of variously sized tires.

Although the description above contains specific features, these should not be construed as limiting the scope of the invention but as merely providing illustrations of some presently preferred embodiments of this invention. Thus the scope of the invention should be determined by the appended claims and their legal equivalents.

I claim:

1. A shield to protect vehicle body panels during the application of cleaner or protectant to a tire comprising:

a first elongated flexible collar sized to fit about an outer circumference of a tire;

a plurality of connectors disposed along ends of said first collar;

a partially cutout segment on said first collar, said cutout segment being disposed on a lower portion of said tire;

a second wider flexible collar attached to said first collar, said second collar being arcuately disposed on an upper portion of said tire and extending therefrom;

and a flexible tubing connected to an outer edge of said second collar wherein said first and second collars encompass said tire and provide protection to said vehicle body panels from overspray during said application of cleaner or protectant to said tire.

* * * * *